US009561671B1

(12) United States Patent
Herrmann et al.

(10) Patent No.: US 9,561,671 B1
(45) Date of Patent: Feb. 7, 2017

(54) INK JET COAXIAL DRUM SYSTEM WITH INTER-COPY GAP TRACKING

(71) Applicant: XEROX CORPORATION, Norwalk, CT (US)

(72) Inventors: Douglas K Herrmann, Webster, NY (US); Jason M Lefevre, Penfield, NY (US); Derek A Bryl, Webster, NY (US); Linn C Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/180,208

(22) Filed: Jun. 13, 2016

(51) Int. Cl.

| | |
|---|---|
| ***B41J 11/00*** | (2006.01) |
| ***B65H 5/22*** | (2006.01) |
| ***B65H 29/24*** | (2006.01) |
| ***B41J 2/01*** | (2006.01) |
| ***B41J 13/22*** | (2006.01) |

(52) U.S. Cl.
CPC ..... *B41J 11/0085* (2013.01); *B41J 2/01* (2013.01); *B41J 13/226* (2013.01); *B65H 5/222* (2013.01); *B65H 5/226* (2013.01); *B65H 29/243* (2013.01); *B65H 2406/33* (2013.01); *B65H 2406/362* (2013.01)

(58) Field of Classification Search
CPC ..... B41J 2/01; B41J 11/0085; B41J 11/06; B41J 13/226; B41F 21/102; B65H 5/222; B65H 5/226; B65H 2406/33; B65H 2406/332; B65H 2406/34525; B65H 2406/3454; B65H 2406/362; B65H 2406/3622; B65H 2406/3632; B65H 29/243
See application file for complete search history.

(56) References Cited

U.S. PATENT DOCUMENTS

| | | | | |
|---|---|---|---|---|
| 4,145,040 | A * | 3/1979 | Huber | B65H 5/226 271/195 |
| 4,312,007 | A | 1/1982 | Winfield | |
| 4,574,291 | A | 3/1986 | Wimmer | |
| 4,739,346 | A | 4/1988 | Buckley | |
| 5,006,900 | A * | 4/1991 | Baughman | G03G 15/1685 399/298 |
| 6,357,869 | B1 * | 3/2002 | Rasmussen | B41J 11/0025 271/196 |
| 6,581,571 | B2 * | 6/2003 | Kubesh | F02D 41/146 123/406.44 |
| 8,177,231 | B2 | 5/2012 | Fukui et al. | |
| 9,315,331 | B2 * | 4/2016 | Gieser | B65G 29/00 |

OTHER PUBLICATIONS

U.S. Appl. No. 15/070,036 to Douglas K. Herrmann, filed Mar. 15, 2016 and entitled Dual Vacuum Belt System with Adjustable Inter-Copy Gap.

* cited by examiner

*Primary Examiner* — Anh T. N. Vo

(57) ABSTRACT

A media transport system provides full vacuum under media as the media traverses an entire print path of an ink jet printer while simultaneously providing for a no-vacuum inter-copy gap that moves along with the media past print heads of the ink jet printer. This is accomplished with a dual vacuum inner/outer vacuum drum system that includes a first drum that has a matrix of holes that allows for full coverage of vacuum with a second underlying drum that is shifted to align a second set of holes to match the sheet pitch. By shifting the second drum in relation to the first drum, a combination set of holes is aligned to provide full vacuum across the media while a column of holes is blocked to provide a non-vacuum inter-copy gap.

20 Claims, 7 Drawing Sheets

INK JET COAXIAL DRUM SYSTEM WITH INTER-COPY GAP TRACKING

BACKGROUND

Cross reference is hereby made to copending and commonly assigned U.S. patent application Ser. No. 15/070,036 to Douglas K. Herrmann, filed Mar. 15, 2016 and entitled DUAL VACUUM BELT SYSTEM WITH ADJUSTABLE INTER-COPY GAP.

1. Field of the Disclosure

This disclosure relates generally to printing or recording devices that deposit ink on a recording media, such as paper. More specifically, the invention relates to such devices wherein a rotating cylindrical drum moves a sheet of paper beneath an ink jet print head. In particular, the invention relates to the aspects of rotation of the drum with recording media attached thereto by vacuum air flow while simultaneously controlling vacuum air flow through inter-copy gaps.

2. Description of Related Art

In ink jet printers where it is necessary for a vacuum drum transport to transport media under ink depositing print heads, the area where no sheet is present at the inter-copy gap creates unwanted air flow past the print heads through a gap between the print heads and media attached to the vacuum drum. This air flow creates turbulence around ink jets of the print heads and ink droplets from the ink jets are deflected from their intended trajectory. This leads to degraded print accuracy and a distorted image.

A problem is created with vacuum drum systems in that the technology used to create the vacuum under media also creates a vacuum at the inter-copy gap. With no media to block the air flow caused by the vacuum, air is pulled past ink jet heads and the air velocity causes dispersion of the jetted ink drops between the print heads and the media. This sudden change in air velocity under the print heads also induces turbulent air flow at the jetting plate surface. The turbulent air generates eddy currents across the print head face plate. These currents dry the ink meniscus in each jetting port resulting in increased numbers of misdirected and missing jets that develop during a print run. Ideally, the vacuum should be present only under the media and not at the inter-copy gap. The media, however, needs to have vacuum up to the edges of each sheet so a change in a permanent underlying plenum would create a no vacuum area under the print head and lead to the media separating from the drum and creating an uneven print surface. Hence, the need for an improvement specifically targeting those ink jet print systems with vacuum drum transport through the ink jetting zone.

Vacuum drum transports are old as evidenced by U.S. Pat. No. 8,177,231 which shows the use of a vacuum drum to move a sheet through an image forming device. The drum has vacuum, however, the system does not make any accommodations to remove air flow at the inter-copy gap or for different inter-copy gap areas of the sheet. U.S. Pat. No. 4,312,007 discloses an ink jet printer that employs a rotating cylinder to move a sheet of paper beneath an electrically driven and piezoelectrically actuated ink ejection mechanism. In U.S. Pat. No. 4,574,291 a synchronizer is disclosed for generating a pulsed trigger signal synchronized with the angular position of a rotating object, such as, a drum in an ink jet copy machine. A drive system for an ink jet printer that employs a rotating drum is disclosed in U.S. Pat. No. 4,739,346.

BRIEF SUMMARY

In answer to the above-mentioned shortcomings of previous attempts at using vacuum transports to feed media through an ink jet imaging zone without image defects, an ink jet printing system is disclosed that utilizes a coaxial vacuum drum system to create a dynamic inter-copy gap (ICG) that moves with media as the media is transported past ink jet print heads. By creating a closed IGC that moves with the media vacuum at the IGC air disturbance is reduced or eliminated as media passes under the print heads. This, in turn, reduces or eliminates the corresponding image quality defects near the leading and trailing edges of printed media.

BRIEF DESCRIPTION OF THE DRAWINGS

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The terms "sheet" or "media" herein interchangeably refer to a usually flimsy physical sheet of paper, plastic, or other suitable physical substrate for images.

Figure 1:
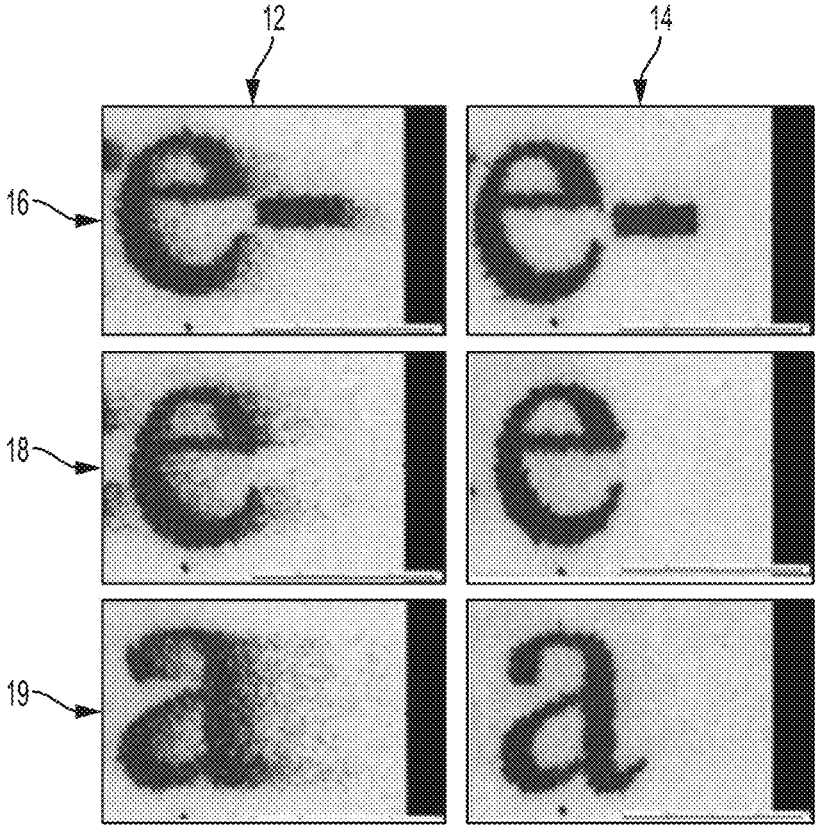

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
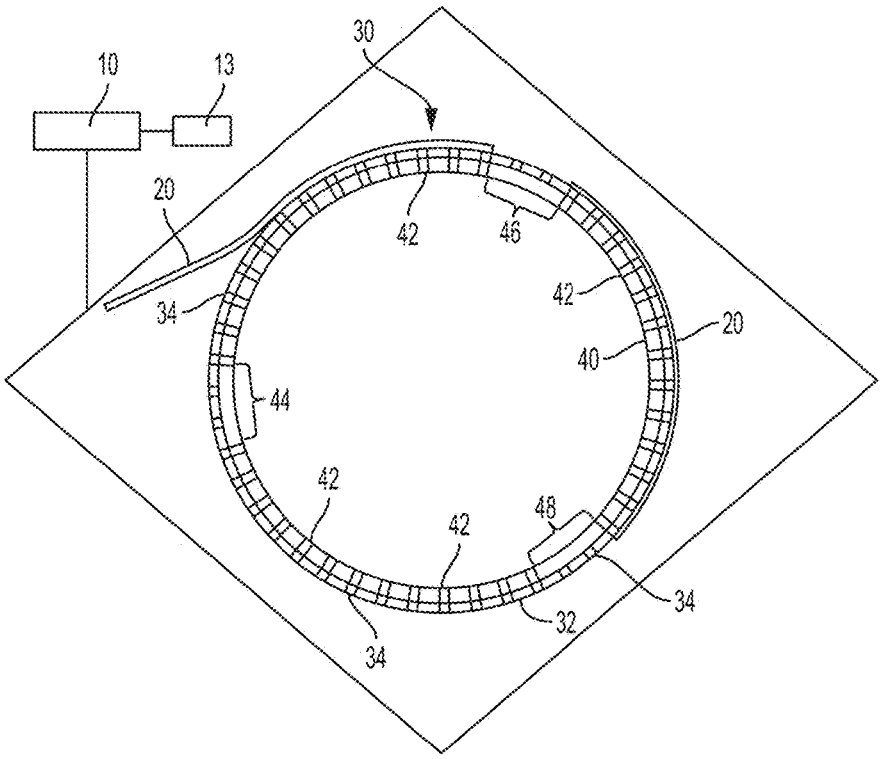
Figure 3:
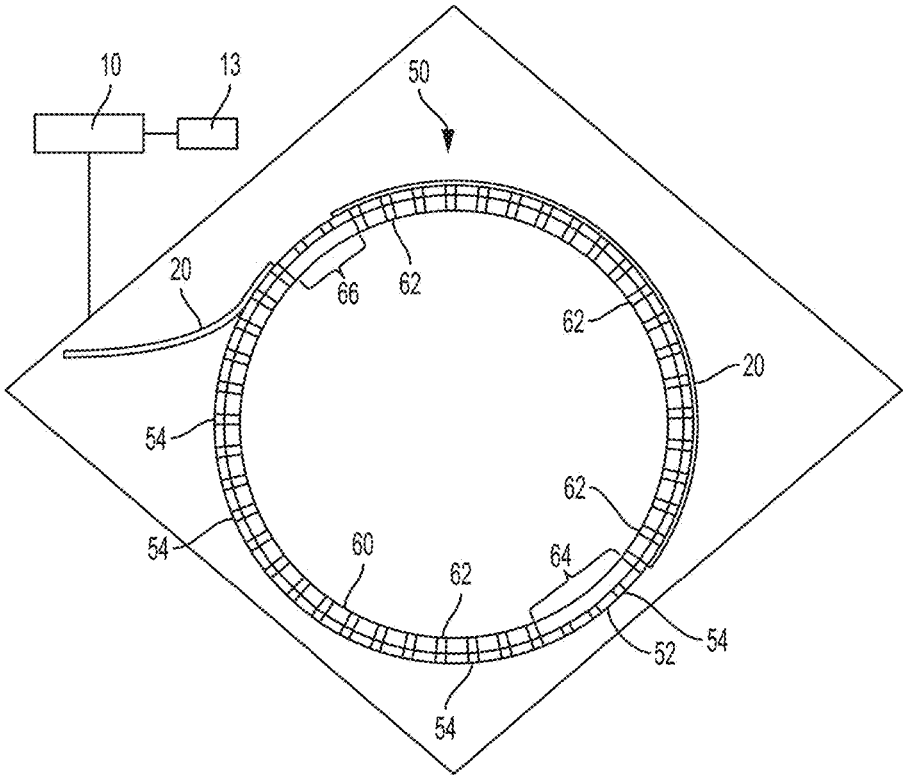
Figure 4:
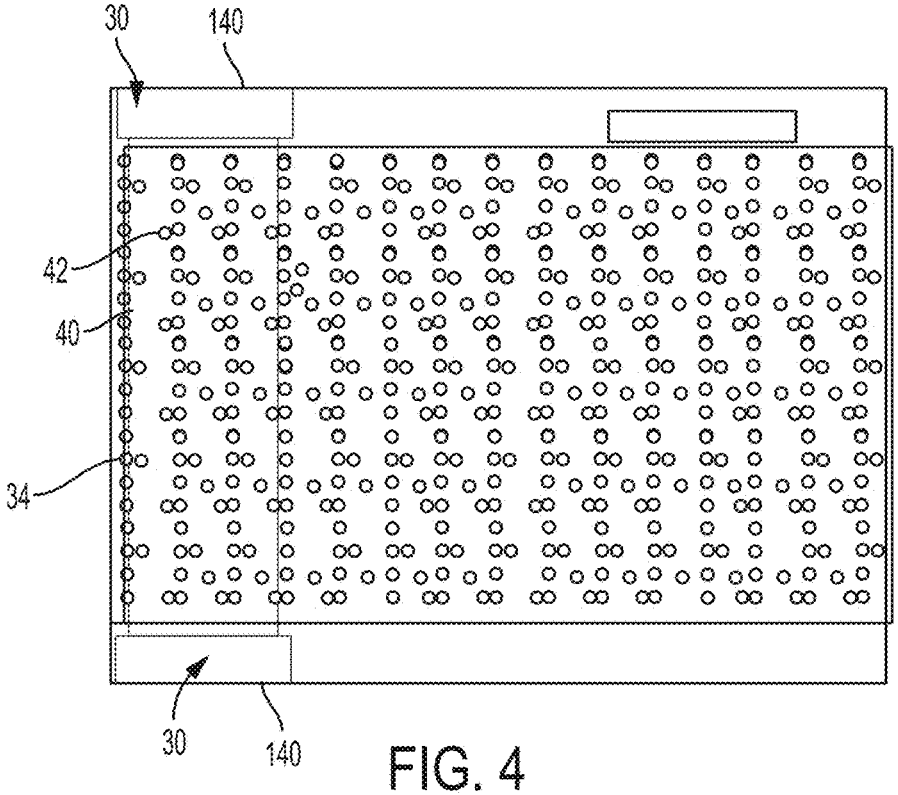
Figure 5A:
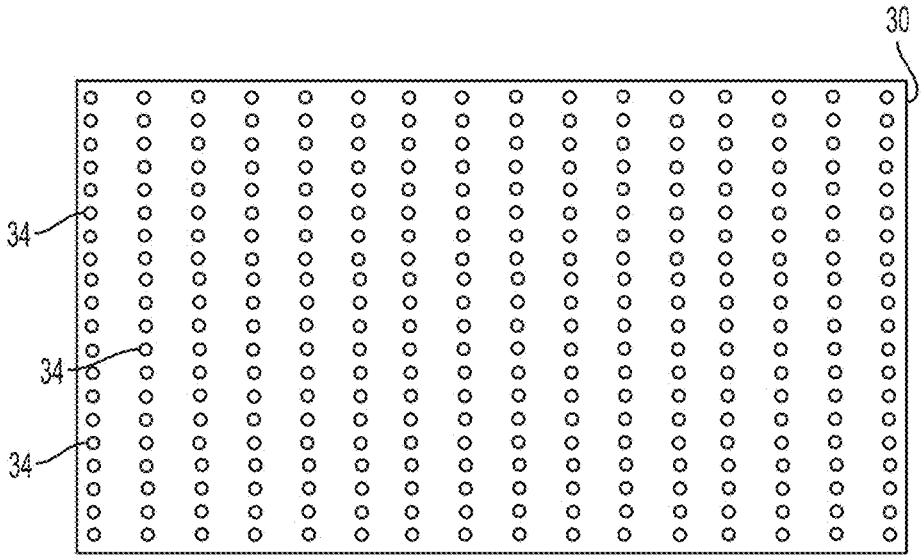
Figure 5B:
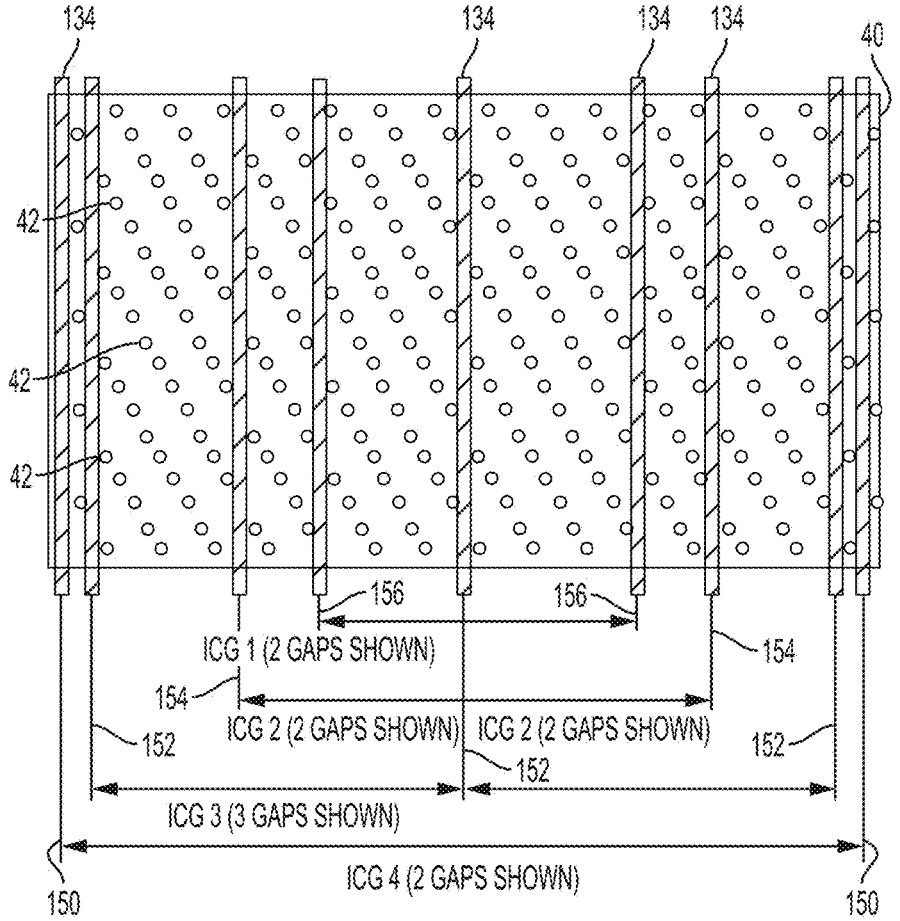
Figure 6A:
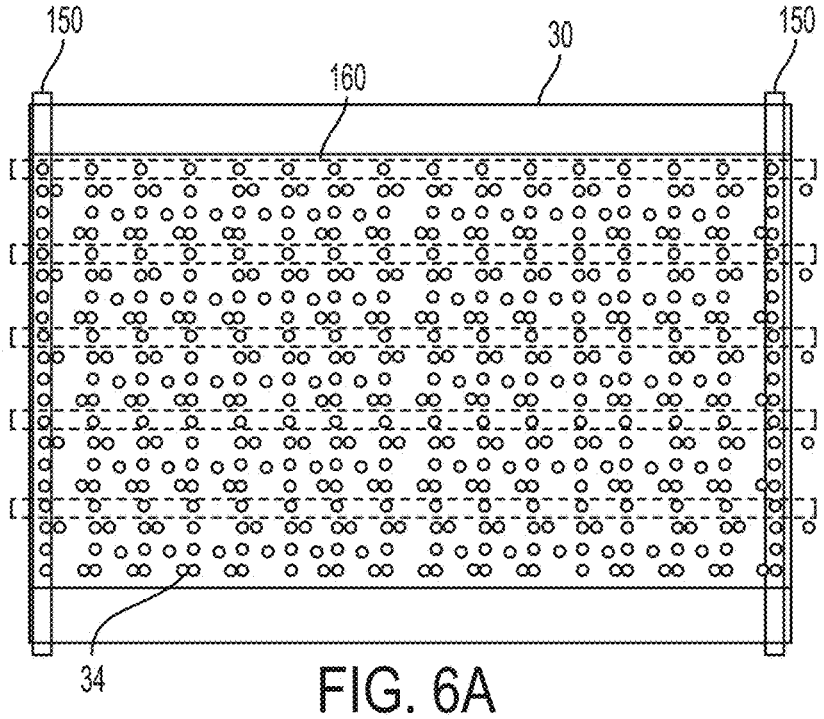
Figure 6B:
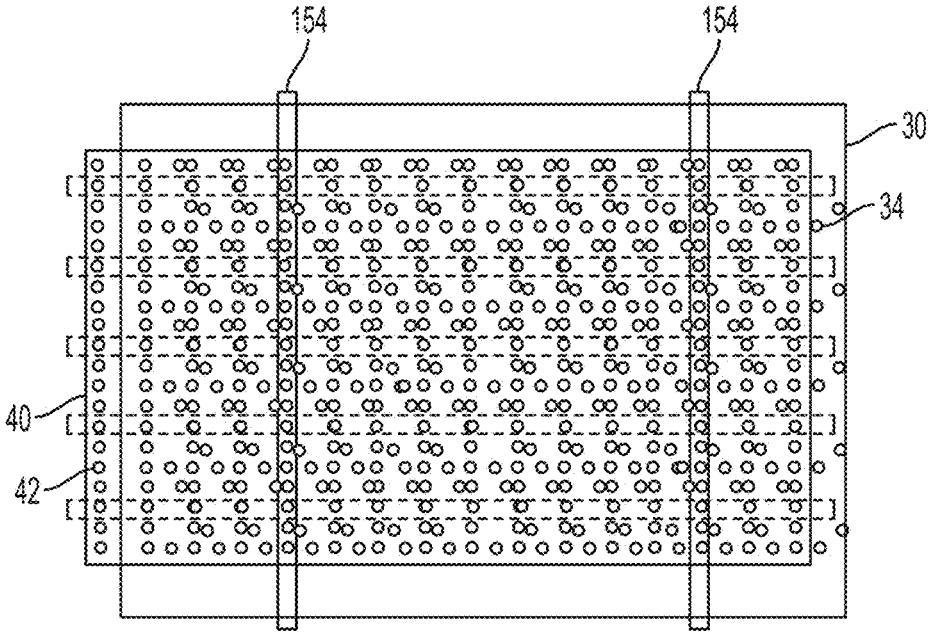
Figure 7:
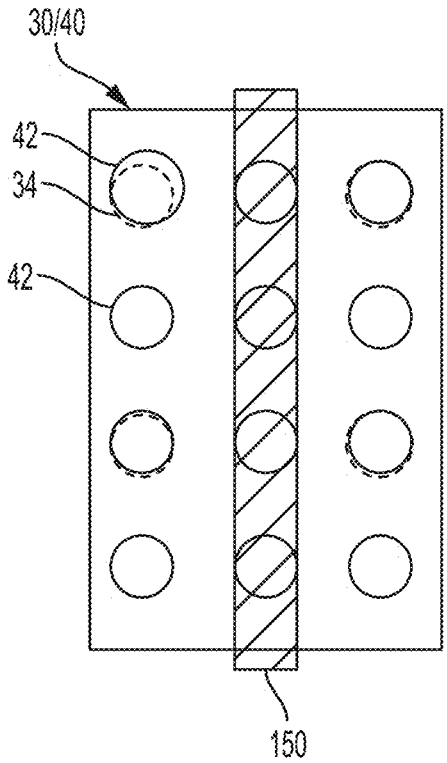

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

FIG. 1 is a close-up diagram illustrating a sheet of media effected by vacuum airflow;

FIG. 2 is an enlarged, partial side view of an embodiment of a sheet transport in accordance with the present disclosure;

FIG. 3 is an enlarged, partial side view of another embodiment of a sheet transport in accordance with the present disclosure;

FIG. 4 is a top view schematic diagram illustrating a flatten view of coaxial drums shown in FIG. 2;

FIGS. 5A and 5B are top view schematic diagrams illustrating a portion of the sheet transport device herein;

FIGS. 6A and 6B are top view schematic diagrams illustrating a portion of the sheet transport device herein; and FIG. 7 is a top view diagram illustrating a portion of the sheet transport device herein in accordance with the present disclosure.

Turning to FIG. 1, and as mentioned above, airflow disturbances in a conventional ink jet printer 10 (such as, in U.S. Pat. No. 4,312,007) in FIG. 2 at the inter-copy gap from a vacuum system can cause leading edge and trailing edge (of the print media) disturbances that affect ink drop placement and degrade print quality. FIG. 1 illustrates undesirable effects of air being drawn into vacuum holes that are close to the trailing or leading edges of the media, where column 12 illustrates the effects of air being drawn into vacuum holes adjacent the trailing edge of a sheet of media, and column 14 illustrates the effects of the devices and methods herein which prevent air from being drawn into vacuum holes that are close to the trailing or leading edges of the sheet of media. In FIG. 1, row 16 illustrates the outboard portion out a sheet of media, row 18 illustrates the center of the sheet of media, and row 19 illustrates the inboard edge of the sheet of media. As can be seen in column 12 of FIG. 1, the airflow from the vacuum holes creates turbulence around the jets, and the ink droplets are deflected from their intended trajectory, shown in the increased blurring in column 12 (which is contrasted by the systems and devices herein, which produce the clearer results shown in column 14 in FIG. 1).

The heretofore-mentioned vacuum flow disturbance is diminished or eliminated with use of the coaxial vacuum drum transport in accordance with the present disclosure in FIG. 2 where a sheet 20 is shown completely attached to surface 32 of an outer vacuum transport drum 30 conventionally mounted for rotation about an axis therethrough in a circular pattern. A partial sheet 20 is shown en route for attachment to drum surface 32. Outer drum 30 has a full matrix of holes 34 therethrough with none of the holes being blocked to vacuum flow. An inner coaxial vacuum drum transport 40 has a partial matrix of holes 42 therethrough with areas 44, 46 and 48 of inner coaxial vacuum drum transport 40 void of holes to correspond with inter-copy gaps between sheets 20 placed onto drum surface 32. Thus, inter-copy gap areas 44, 46 and 48 present three inter-copy gap alignment positions.

Inner and outer coaxial vacuum drum transports 40 and 30, respectively, index relative to each other to get the hole-pattern set up in FIG. 2. The relative movement of the two drums only occurs when ink jet printer 10 is set-up for a run (i.e. during cycle-up). Controller 13 knowing the sheet-size and Inter-document zone conventionally adjusts the drum relative positions to get the proper zone of holes blocked for the desired inter-copy or inter-document zone. Once this is set, the drums are moved together at the same velocity, and the drum system would now be synchronous, and the sheets would be introduced to the marking transport drum 30 at a time and cadence to have the designated inter-copy gap in the drum line-up to the sheets coming in.

In further accordance with the present disclosure, FIG. 3 shows an alternative coaxial vacuum drum transport 50 that includes an outer drum 52 with holes 54 therein that accommodate vacuum flow therethrough and an inner drum 60 coaxial therewith having holes 62 that allow vacuum air flow through the holes. Media 20 is attracted to outer surface 54 of vacuum drum transport 50 by a conventional vacuum source for transport past an ink jet print head. This coaxial vacuum drum transport is identical to coaxial vacuum drum transport 30 except that inner drum 60 includes only two areas 64 and 66 thereof that are without of holes therein. Areas 64 and 66 are two inter-copy gap positions corresponding to the size of media 20.

FIG. 4 shows a top down view of flattened coaxial drums 30, 40 with conventional independent drive systems 140 to allow for inner and outer drum hole alignment. FIG. 4 also shows the drum hole matrix 42 of the inner drum 40. Also shown in FIG. 4 is the outer drum 30 that includes a pattern of vacuum holes 34. FIGS. 5A-5B show the drums 30, 40 that overlapped in FIG. 4 separated. More specifically, FIG. 5A illustrates the regular pattern of vacuum hole openings 34 that are within the outer drum 30 (without showing the inner drum 40). To the contrary, FIG. 5B illustrates the irregular pattern of vacuum hole openings 42 of the inner drum 40 (without showing the outer drum 40).

FIG. 5B also illustrates various areas of the inner drum 40 that will create blocked-hole regions 134 when the inner drum 40 is positioned at different locations relative to the outer drum 30, and such regions 134 are shown as items 150, 152, 154, and 156 in FIG. 5B. For example, if a relatively small sheet is being transported on the outer drum 30, the inner drum 40 can be positioned to align the blocked-hole regions 156 with the vacuum hole openings 34 of the outer drum 30 (e.g., an ICG 1 measure). If a larger sheet is being transported on the outer drum 30, the inner drum 40 can be positioned to align the blocked-hole regions 154 with the vacuum hole openings 34 of the outer drum 30 (e.g., an ICG 2 measure). Similarly, if a different size sheet is being transported on the outer drum 30, the inner drum 40 can be positioned to align the blocked-hole regions 152 with the vacuum hole openings 34 of the outer drum 30 (e.g., an ICG 3 measure). As an additional example, if a yet larger sheet is being transported on the outer drum 30, the inner drum 40 can be positioned to align the blocked-hole regions 150 with the vacuum hole openings 34 of the outer drum 30 (e.g., an ICG 4 measure). Therefore, FIGS. 5A-5B illustrate that by changing the relative positions of the inner drum 40 and the outer drum 30, the positions (and potential sizes) of the blocked-hole regions 150, 152, 154, and 156 can be changed to accommodate different sizes and different locations of different inter-copy gaps that will be mandated by different sized sheets of media being transported on the outer drum 30.

FIGS. 6A-6B illustrate the situation where the outer drum 30 has an irregular pattern of vacuum hole openings 34, while the inner drum 40 has a regular pattern of vacuum hole openings 42. FIGS. 6A-6B also illustrate how the relative positions of the drums 30, 40 create block-hole regions 150 (FIG. 6A) and 154 (FIG. 6B) that are similar to the block-hole regions 150, 154 shown in FIG. 5B. Row at 160 is overlapping and is where vacuum is present. FIG. 7 also illustrates the overlapped drums 30, 40 and how the vacuum hole openings 42 of the inner drum 40 sometimes align with the vacuum hole openings 34 (shown using dashed line circles) of the outer drum 30, and sometimes do not. This allows the creation of the block-hole regions 150.

In recapitulation, as shown in FIGS. 1-7, multiple rows are used so that the hole patterns on the inner drum repeat at a specific row multiples, providing for several pitch timing and inter-copy gaps. By shifting the inner drum in relation to the outer drum, a combination set of holes is aligned to provide a full vacuum across the sheet, while a column of holes is blocked to provide the non-vacuum inter-copy gap. In this way, the non-vacuum inter-copy gap travels with the sheets as the sheets are transported under the ink jet heads. As the print media sheets transition from the trailing edge of the previous sheet to the leading edge of the next sheet, no open vacuum drum holes are present to create the vacuum induced air disturbance under the print heads. The belts are each indexed on separate coaxial drives to align the holes of the inner drum to the holes of the outer drum so that the non-vacuum inter-copy gap and pitch for that sheet size is created.

Thus, the inner and outer drum index relative to each other to establish the non-vacuum inter-copy gap set up for the size and spaced sheet that will be transported on the drum. The relative movement of the two drum only occurs when the machine is set-up for a run (i.e., during cycle-up), knowing the sheet-size and inter-document zone (IDZ) and the relative drum positions are adjusted to achieve the proper zone of holes blocked for the desired non-vacuum inter-copy gap or inter-document zone. Once the non-vacuum inter-copy gap is established, the drums move together at the same velocity, and the drum system is synchronous, and the print media sheets are introduced to the marking transport drum at a time and cadence to have the designated non-vacuum inter-copy gap to match the incoming sheets.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A dual drum vacuum sheet transport apparatus, comprising:

a first drum, said first drum having a first pattern of first vacuum holes;

a second drum, said second drum having a second pattern of second vacuum holes; and a controller electrically connected to said first drum, said second drum is positioned coaxially with respect to said first drum, said first drum contacts sheets to be transported, when transporting said sheets on said first drum separated by spaces between said sheets, said first drum and second drum move together, and when not transporting said sheets, said controller controls said first drum to rotate relative to said second drum to move said first drum relative to said second drum so as to leave blocked-hole regions of said first drum where said spaces between said sheets are located, said blocked-hole regions are locations of said first drum where said first vacuum holes are unaligned with said second vacuum holes and said first vacuum holes are blocked by said second drum.

2. The dual drum vacuum sheet transport apparatus according to claim 1, wherein said first pattern of first vacuum holes being different from said second pattern of second vacuum holes, and wherein relative movement of said first drum to said second drum causes a change to at least one of the size of said blocked hole regions and the location of said blocked hole regions to accommodate different sized spaces between said sheets.

3. The dual drum vacuum sheet transport apparatus according to claim 2, wherein said first pattern of said first vacuum holes is a uniform pattern and said second pattern of said second vacuum holes is a non-uniform pattern.

4. The dual drum vacuum sheet transport apparatus according to claim 1, including a vacuum source in communication with said second drum.

5. The dual drum vacuum sheet transport apparatus according to claim 1, wherein said first pattern of first vacuum holes is aligned with said second pattern of second vacuum holes so that vacuum is present only under said sheets and holes are blocked at inter-copy gaps between said sheets.

6. The dual drum vacuum sheet transport apparatus according to claim 5, wherein said second pattern of second vacuum holes is offset from said first pattern of said first vacuum holes.

7. The dual drum vacuum sheet transport apparatus according to claim 1, wherein movement of said first drum relative to said second drum occurs at set-up of a printer for printing sheets.

8. The dual drum vacuum sheet transport apparatus according to claim 5, wherein said blockage at said inter-copy gaps is moved along with said sheets as they are conveyed by said first drum.

9. A recording medium vacuum transport apparatus for transporting recording medium past ink jet print heads in a printing machine, comprising:

an outer cylindrical drum, rotatable about its longitudinal axis, for receiving upon the outside of its cylindrically curved surface a sheet of recording medium onto which indicia is to be printed;

an inner cylindrical drum, rotatable about said longitudinal axis, said inner cylindrical drum being positioned coaxially with respect to said outer cylindrical drum;

said outer cylindrical drum having a matrix of holes that facilitate full vacuum coverage of said recording medium, and wherein said inner cylindrical drum has a different matrix of holes therein;

a vacuum source;

a controller electrically connected to said first and second cylindrical drums; and wherein said controller is adapted to shift said inner cylindrical drum to align a set of said different holes to match a pitch of said recording medium on said outer cylindrical drum to provide said full vacuum coverage across said recording medium while simultaneously a column of said matrix of holes in said outer cylindrical drum is blocked to provide non-vacuum inter-copy gaps.

10. The recording medium vacuum transport apparatus of claim 9, wherein inner cylindrical drum includes a plurality of areas without said different holes.

11. The recording medium vacuum transport apparatus of claim 10, wherein each of said plurality of areas without said different holes in said inner cylindrical drum is used to block a column of said matrix of holes in said outer cylindrical drum to accommodate different pitches of recording medium attached to said outer cylindrical drum.

12. The recording medium vacuum transport apparatus of claim 9, wherein said matrix of holes in said outer cylindrical and said different matrix of holes in said inner cylindrical drum are aligned by said controller such that vacuum is present only under said recording medium.

13. The recording medium vacuum transport apparatus of claim 12, wherein said outer cylindrical drum and said inner cylindrical drum are positioned to create a dynamic inter-copy gap that moves with said recording medium as the recording medium is transported past said ink jet print heads.

14. The recording medium vacuum transport apparatus of claim 9, wherein said matrix of holes in said outer cylindrical drum is a uniform pattern and said different matrix of holes in said inner cylindrical drum is a non-uniform pattern.

15. A recording media transport method, comprising:

providing an outer cylindrical drum including a uniform pattern of holes therein;

providing an inner cylindrical drum including a non-uniform pattern of holes therein with said inner cylindrical drum being positioned coaxially with said outer cylindrical drum;

providing a source for supplying a vacuum air flow through said uniform and non-uniform patterns of holes;

providing a controller; and using said controller to shift said inner cylindrical drum relative to said outer cylindrical drum to align a combination set of said uniform and non-uniform pattern of holes to provide full vacuum across said recording media while simultaneously blocking a column of holes in said uniform pattern of holes to provide non-vacuum at inter-copy gaps between recording media attached to said outer cylindrical drum by vacuum air flow from said vacuum source.

16. The recording media transport method of claim 15, including using said recording media transport method in an ink jet printer.

17. The recording media transport method of claim 16, including triggering said shifting of said inner cylindrical drum relative to said outer cylindrical drum only by cycling-up said ink jet printer for a print run.

18. The recording media transport method of claim 15, including moving said inter-copy gaps with said recording media.

19. The recording media transport of claim 18, including providing said controller with recording media size and inter-document zone that is used for adjusting relative positions of said outer cylindrical drum and inner cylindrical drum to obtain the proper zone of holes in said outer cylindrical drum blocked for the desired inter-copy gaps.

20. The recording medium transport of claim 15, wherein said outer cylindrical drum is wider than said inner cylindrical drum allowing movement of said outer cylindrical drum relative to said inner cylindrical drum.

* * * * *